United States Patent [19]

Sumitomo et al.

[11] Patent Number: 4,779,424

[45] Date of Patent: Oct. 25, 1988

[54] HEAT RECOVERY SYSTEM UTILIZING NON-AZEOTROPIC MEDIUM

[75] Inventors: Hiroyuki Sumitomo; Akira Horiguchi, both of Osaka, Japan

[73] Assignee: Hisaka Works, Limited, Osaka, Japan

[21] Appl. No.: 3,010

[22] Filed: Jan. 13, 1987

[51] Int. Cl.[4] ..... F01K 25/06

[52] U.S. Cl. ..... 60/649; 60/651; 60/671; 122/34; 165/104.13

[58] Field of Search ..... 60/649, 651, 671; 122/34; 62/114; 165/104.13

[56] References Cited

U.S. PATENT DOCUMENTS 4,422,297 12/1983 Rojey ..... 60/651

FOREIGN PATENT DOCUMENTS 3406588 8/1985 Fed. Rep. of Germany ..... 62/114

*Primary Examiner*—Albert W. Davis, Jr.

*Attorney, Agent, or Firm*—Armstrong, Nikaido, Marmelstein & Kubovcik

[57] ABSTRACT

A heat recovery system including a closed working fluid loop constituted by connecting an evaporating apparatus supplied with warm waste water, a steam turbine having an output shaft to be coupled to the load, and a condensing apparatus supplied with cooling water, works on the basis of a Rankine cycle and utilize a non-azeotropic mixture as the working fluid.

1 Claim, 2 Drawing Sheets

HEAT RECOVERY SYSTEM UTILIZING NON-AZEOTROPIC MEDIUM

BACKGROUND OF THE INVENTION

Field of the Invention

The present invention relates to a heat recovery system utilizing a non-azeotropic mixture as the working fluid. More specifically, the present invention relates to a heat exchanger dealing with an evaporation or condensation of the non-azeotropic mixture.

Description of the Prior Art

A heat recovery system based upon a Rankine cycle which is adapted to recover heat from warm waste water discharged from a factory, and to utilize it for generating electric power or the like as the energy source has been well known. In such conventional system, a coolant such a as fluorine gas is used as the working fluid, which circulates through a working fluid system constituted by connecting an evaporator, steam turbine and condenser in a closed loop. The working fluid, which is initially the liquid, is heated in a evaporator and changed into vapor having a high temperature and pressure, which is then fed into the steam turbine to work while passing therethrough while expanding. The vapor reduced to a low temperature and pressure after completing the work is exhausted from the steam turbine to the condenser, in which it is cooled and condensed and pumped back into the evaporator to repeat similar cycles thereafter. An output shaft of the steam turbine is coupled to the load of a generator or the like.

In such a heat recovery system, since the larger the temperature difference the higher the efficiency, it is devised to increase the temperature of working fluid vapor supplied to the steam turbine by providing a heater at an outlet of the evaporator. In such case, however, an additional equipment must be specially installed, resulting in a high cost.

SUMMARY OF THE INVENTION

The present invention originated in appreciation of such problems, and is intended to utilize the high vapor temperature obtained from an evaporator and the low condensing temperature in a condenser, by using a non-azeotropic fluid in lieu of a conventional working fluid consisting of a single component.

Therefore, it is an object of the present invention to provide a heat recovery system utilizing a non-azeotropic mixture as the working fluid.

It is another object of the present invention to provide an evaporating apparatus having a suitable construction for a non-azeotropic mixture.

It is a further object of the present invention to provide a condensing apparatus having a suitable construction for a non-azeotropic mixture.

The heat recovery system of the present invention includes a working fluid system constituted by connecting the evaporating apparatus which is supplied with warm waste water, a steam turbine having an output shaft coupled to the load, and a condenser supplied with cooling water in a closed loop. The evaporating apparatus comprises the evaporator through which the non-azeotropic mixture being evaporated and fluid as heat source flow counter-current to each other, a vapor-liquid separator connected to a non-azeotropic mixture outlet of the evaporator, a reflux pipe extending from a liquid outlet of the vapor-liquid separator to a non-azeotropic mixture inlet of the evaporator to a non-azeotropic mixture inlet of the evaporator, and a variable restrictor provided in the reflux pipe. The amount of refluxing fluid being adjusted by the variable restrictor to maintain the optimum thermodynamic concentration of the non-azeotropic mixture in the evaporator. The condensing apparatus comprises a condenser through which the non-azeotropic mixture being condensed and cooling water flow counter-current to each other, a vapor-liquid separator connected to a non-azeotropic mixture outlet of the condenser, a reflux pipe extending from a vapor outlet of the vapor-liquid separator to a non-azeotropic mixture inlet of the condenser, and a variable restrictor provided in the reflux pipe. The amount of refluxing vapor being adjusted by the variable restrictor to maintain the optimum thermodynamic concentration of the non-azeotropic mixture in the condenser.

The evaporating apparatus of the non-azeotropic mixture in accordance with the present invention includes the circulation type evaporator through which the non-azeotropic mixture being evaporated and fluid as a heat source flow in full counter-current flow, the vapor-liquid separator connected to the non-azeotropic mixture outlet of the evaporator, the reflux pipe extending from the liquid outlet of the vapor-liquid separator to the non-azeotropic mixture inlet of the evaporator, and the variable restrictor provided in the reflux pipe. The amount of refluxing fluid is adjusted by the variable restrictor to maintain the optimum thermodynamic concentration of the non-azeotropic mixture in the evaporator. Thus, an effective evaporating apparatus for the non-azeotropic mixture which is able to secure the anticipated evaporating temperature is provided.

The condensing apparatus of the non-azeotropic mixture in accordance with the present invention includes the circulation type condenser through which the non-azeotropic mixture being condensed and cooling water flow in full counter-current flow, the vapor-liquid separator connected to the non-azeotropic mixture outlet of the condenser, the reflux pipe extending from the vapor outlet of the vapor-liquid separator to the non-azeotropic mixture inlet of the condenser, and the variable restrictor provided in the reflux pipe. The amount of refluxing fluid is adjusted by the variable restrictor to maintain the optimum thermodynamic concentration of the non-azeotropic mixture in the condenser. Thus, an effective condensing apparatus for the non-azeotropic mixture which is able to secure the anticipated condensing temperature variation is provided. Besides, because of the non-azeotropic mixture the mixing of condensed liquid and vapor is usually unavoidable, but according to the present invention, the vapor is prevented from being trapped and accumulated within condenser, thus the high condensing performance can be anticipated.

DESCRIPTION OF THE PREFERRED EMBODIMENT

Figure 1:
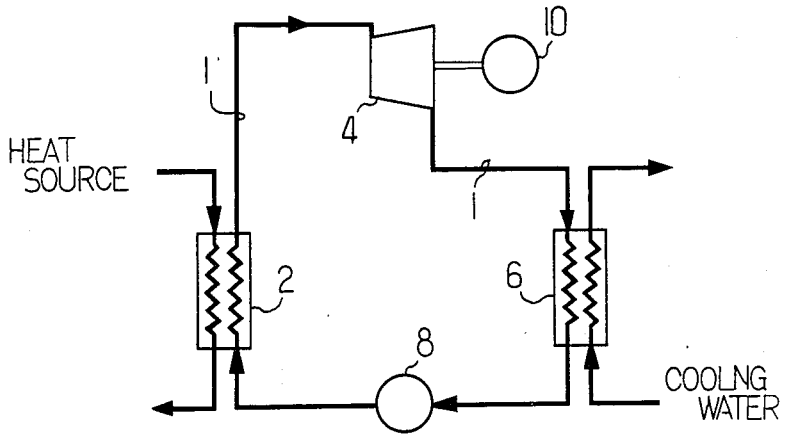
FIG. 1 is a block diagram showing an embodiment of a heat recovery system in accordance with the present invention.

Referring to FIG. 1 showing one embodiment in accordance with the present invention, a heat recovery system includes a working fluid system (1) forming a closed loop by connecting an evaporating apparatus (2), steam turbine (4) and condenser (6), through which a non-azeotropic mixture circulates as the working fluid and which works on the basis of a Rankine cycle to recover heat from the warm waste water discharged from factories, power plants and other various plants as the energy source for generating the electric power. Here the non-azeotropic mixture represents mixtures of a so-called binary system or multicomponent system except azeotropic mixtures. The working fluid circulating through the working fluid system is changed inside the evaporating apparatus (2) into vapor having a high temperature and pressure, which is then fed into the steam turbine (4) to work while as passing therethrough as expanding. The vapor reduced to a low temperature and pressure after completing the work is exhausted from the steam turbine (4) to the condenser (6), in which it is cooled and condensed and returned to the evaporating apparatus (2) by a pump (8) to repeat subsequent similar cycles. An output shaft of the steam turbine (4) is coupled to a generator (10).

Figure 2:
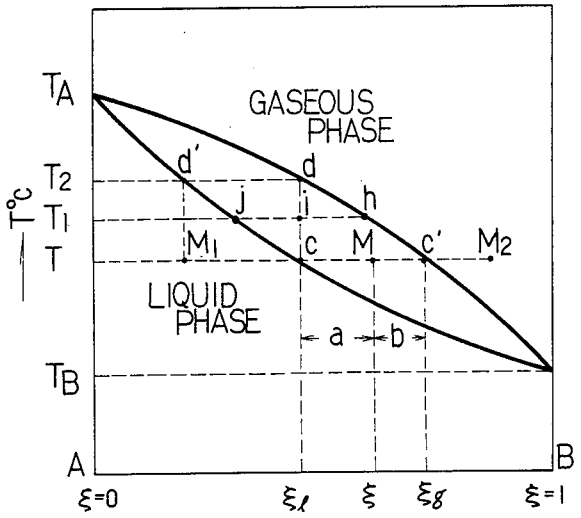
FIG. 2 is a vapor-liquid equilibrium diagram of a non-azeotropic mixture.

FIG. 2 shows the relationship between the concentration and temperature of a non-azeotropic mixture comprising components A and B, when the individual saturated temperature of components A and B under the constant pressure is designated respectively as TA and TB. Now, if the weight of A and B is designated respectively as GA and GB, the concentration refers to weight $\xi$ of the component B included per unit weight of the non-azeotropic mixture. That is, $$\xi = \frac{GB}{GA + GB}.$$

When the vapor and liquid phase is in equilibrium under the temperature T, it should be found from points on the vapor phase and liquid phase lines corresponding thereto, that the concentration of liquid phase is $\xi l$ and that of the vapor phase is $\xi g$. Moreover, when the resultant concentration of the liquid and vapor phases is $\xi$, the state of mixture is represented at point M, where the ratio of weight between the liquid and vapor is inversely proportional to the horizontal distance a and b from the point M to the liquid phase and vapor phase lines.

Now, when the point M is inside the area surrounded by the liquid phase line and vapor phase line, the mixture is divided into both the vapor and liquid phases, but when the point M coincides with either line or steps outside the area, only one of the two phases remains. For example, point $M_1$ indicates unsaturated liquid and point $M_2$ represents superheated steam. When the temperature changes, however, the state of mixture will also change. For example, when the temperature of unsaturated liquid indicated at point $M_1$ is increased to $T_2$, it changes into saturated solution and parts to evaporate when the temperature is raised thereabove. In short, when the solution of concentration $\xi l$ is heated at constant pressure, boiling (evaporation) starts at point e, and the composition and state of the vapor phase (steam) which is in equilibrium then is indicated at point c'. Further heating to the temperature $T_1$ will cause the vapor in the state indicated at point h, and the solution in the state indicated at point j to co-exist at the ratio ji:ih. Still further heating to the temperature $T_2$ will result only in the vapor phase in the state indicated at point d. Any additional heating thereafter will only result in the steam being superheated.

On the contrary, when the vapor of concentration $\xi l$ is cooled at constant pressure, condensation starts at point d, and the composition and state of the vapor phase (steam) which is in equilibrium then is indicated at point d'. Further cooling to the temperature $T_1$ will cause the vapor phase in the state indicated at point h, and the solution in the state indicated at point j to co-exist at the rate ji:ih. Still further cooling to the temperature T will result only in the liquid phase in the state indicated at point C. Any additional cooling thereafter will only result in the solution being supercooled.

Figure 3:
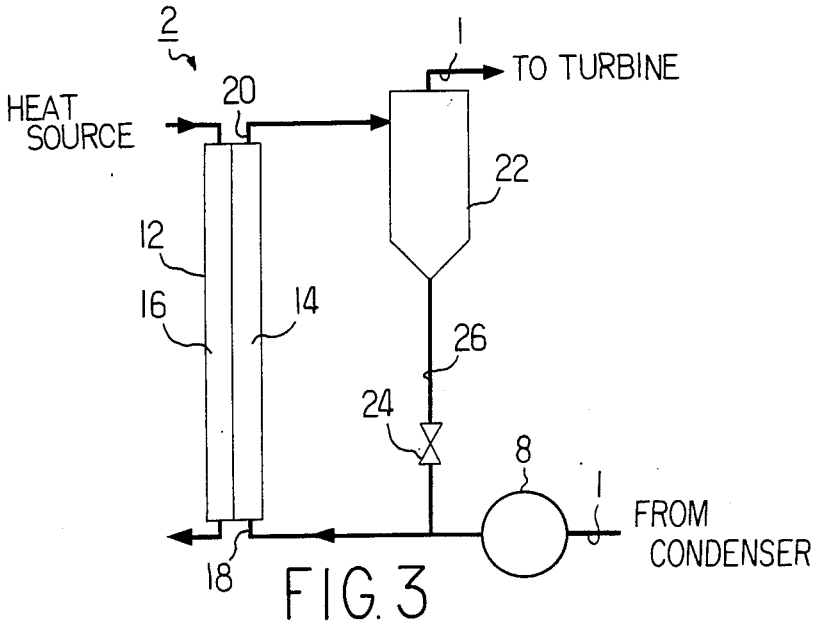
FIG. 3 is a block diagram of an evaporating apparatus in accordance with the present invention.

Now referring to FIG. 3, showing the evaporating apparatus (2) in detail, an evaporator (12) includes a passage way (14) of the working fluid and a passage way (16) of fluid as a heat source such as warm waste water from a factory, the working fluid and the heat source fluid being in a full counter-current relationship. The liquefied working fluid from the condensing apparatus (6) (shown in FIG. 1) is supplied to a working fluid inlet (18) of the evaporator (12) through the pump (8). A vapor-liquid separator (22) is provided at a working fluid outlet (20) of the evaporator (12). A vapor outlet of the vapor-liquid separator (22) is connected to the steam turbine (4) (shown in FIG. 1). A liquid outlet of the vapor-liquid separator (22) is linked to the working fluid inlet (18) of the evaporator (12) through a reflux pipe (26) mounted with a variable restrictor (24).

The working fluid vapor produced within the evaporator (12) is fed to the steam turbine (4) via the vapor-liquid separator (22). The liquefied working fluid separated from the working fluid vapor in the vapor-liquid separator (22) is returned to the evaporator (12) through the reflux pipe (26) together with the working fluid from the condensing apparatus (6).

When the optimum working fluid concentration to secure temperatures T and $T_2$ respectively at the working fluid inlet (18) and outlet (20) of the evaporator (12) is indicated at $\xi l$, and the working fluid having that concentration is directed into the evaporator (12), first at the temperature T, initial steam in the state indicated at point c' is produced (FIG. 2). Until the working fluid is heated inside the evaporator (12) to reach the temperature $T_2$, the working fluid vapor in the state indicated at each point on the vapor phase line from points c' to d is produced. Ultimately, the steam in various states (temperature, concentration) from the initial steam indicated at point c' and the final steam indicated at first point d, and the solution indicated at point d' flow from the working fluid outlet (20) of the evaporator (12) to the vapor-liquid separator (22), in which they are separated and the working fluid vapor flows to the steam turbine (4), and the liquefied working fluid to the reflux pipe (26).

The reflux pipe (26) is linked to the working fluid inlet (18) of the evaporator (12) and returns the working fluid from the vapor-liquid separator (22) to the evaporator (22), together with the working fluid discharged from the steam turbine (4) and condensed in the condensing apparatus (6). As described hereinbefore, however, since the working fluid vapor flowing from the vapor-liquid separator (22) to the steam turbine (4) includes the highly concentrated steam of a concentration higher than the optimum concentration ξl in addition to the initial steam, the concentration is higher than the optimum concentration ξl as a whole. Thus, it will be appreciated that the concentration of working fluid circulated from the condensing apparatus (6) to the evaporator (12) is higher than the optimum concentration while the concentration of working fluid entering the vapor-liquid separator (22) is lower than the optimum concentration ξl. Therefore, the variable restrictor (24) is designed to adjust the amount of working fluid returned from the vapor-liquid separator (22) through the reflux pipe (26) such that it flows together with the working fluid from the condensing apparatus (6) and enters into the evaporator (12) exactly in the optimum concentration. Such adjustment of concentration may be readily attained by controlling the variable restrictor (24) employing an usual process controlling technique.

Figure 4:
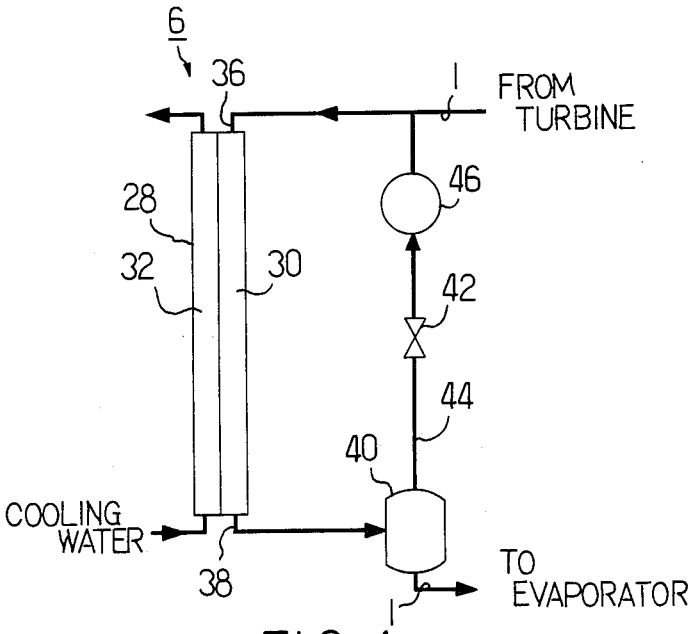
FIG. 4 is a block diagram of a condensing apparatus in accordance with the present invention.

Now, referring to FIG. 4 showing the condensing apparatus in detail, a condenser (28) includes a passage way (30) of the working fluid and a passage way (32) of cooling water, the working fluid and cooling water being in a full counter-current relationship. The working fluid vapor from the steam turbine (4) is supplied to a working fluid inlet (36) of the condenser (28). A vapor-liquid separator (40) is provided at a working fluid outlet (38) of the condenser (28). A liquid phase outlet of the vapor-liquid separator (40) is connected to the circulating pump (8) (shown in FIG. 1) for the working fluid. A vapor phase outlet of the vapor-liquid separator (40) is linked to the working fluid inlet (36) of the condenser (38) through a reflux pipe (44) mounted with a variable restrictor (42) and a booster (46).

The working fluid condensed within the condenser (28) flows to the pump (8) via the vapor-liquid separator (40). The working fluid vapor separated from the liquefied working fluid in the vapor-liquid separator (40) is returned to the condenser (28) through the reflux pipe (44) together with the working fluid vapor exhausted from the steam turbine (4). At this time, the working fluid vapor pressure is built up with the booster (46) by the pressure reduced in the condenser (28). In the same heat recovery system, when a heat pump is used, the reflux pipe (44) is connected to the suction side of the compressor and the booster may be omitted.

When the optimum working fluid concentration to secure temperatures $T_2$ and T respectively at the working fluid inlet (36) and outlet (38) of the condenser (28) is indicated at ξl, and the working fluid vapor having that concentration is directed into the condenser (28), first at the temperature $T_2$, initial condenser liquid in the state indicated at point d′ is produced (FIG. 2). Until the working fluid vapor is cooled inside the condenser (28) to reach the temperature T, the liquefied working fluid in the state indicated at each point on the liquid phase line from points d′ to c is produced. Ultimately, the liquid in various states (temperature, concentration) from the initial condensed liquid indicated at point d′ to the final condensed liquid indicated at point c, and the steam indicated at point c′ flow from the working fluid outlet (38) of the condenser (28) to the vapor-liquid separator (40), in which they are separated and the liquefied working fluid flow to the evaporating apparatus (2) via the pump (8), and the working fluid vapor to the reflux pipe (44).

The refux pipe (44) is linked to the working fluid inlet (36) of the condenser (28), together with the working fluid vapor exhausted from the steam turbine (4). As described hereinbefore, however, since the working fluid circulated from the vapor-liquid separator (40) to the evaporating apparatus (2) and the steam turbine (4) by the pump (8), includes the low concentrated solution of a concentration lower than the optimum concentration ξl in addition to the initial condensed liquid, concentration is lower than the optimum concentration ξl as a whole. Thus, it will be appreciated that the concentration of working fluid vapor circulating from the steam turbine (4) to the condenser (28) is lower than the optimum concentration while the concentration of working fluid vapor entering the vapor-liquid separator (40) is higher than the optimum concentration ξl. Therefore, the variable restrictor (42) is designed to adjust the amount of working fluid vapor returned from the vapor-liquid separator (4) through the reflux pipe (44) such that it flows together with the working fluid from the steam turbine (4) and enters into the condenser (28) exactly in the optimum concentration. Such adjustment of concentration may be readily attained by controlling the variable restrictor (42) employing an usual process controlling technique.

What is claimed is:

1. In a heat recovery system including a working fluid system constituted by connecting an evaporating apparatus supplied with warm waste water, a steam turbine having an output shaft to be coupled to a load and a condensing apparatus supplied with cooling water in a closed loop, an improvement wherein;

the evaporating apparatus comprises an evaporator through which a non-azeotropic mixture being evaporated and a fluid as a heat source are capable of flowing in a full counter-current relationship, a vapor-liquid separator connected to a non-azeotropic mixture outlet of the evaporator, a reflux pipe extending from a liquid outlet of the vapor-liquid separator to a non-azeotropic mixture inlet of the evaporator, and a variable restrictor provided in the reflux pipe, the amount of refluxing fluid being adjustable by said variable restrictor to maintain the optimum thermodynamic concentration of the non-azeotropic mixture in the evaporator, and the condensing apparatus comprises a condenser through which the non-azeotropic mixture being condensed and cooling water are capable of flowing in a full counter-current relationship, a vapor-liquid separator connected to a non-azeotropic mixture output of the condenser, a reflux pipe extending from a vapor phase outlet of the vapor-liquid separator to a non-azeotropic mixture inlet of the condenser, and a variable restrictor provided in the reflux pipe, the amount of refluxing vapor being adjustable by said variable restrictor to maintain the optimum thermodynamic concentration of the non-azeotropic mixture in the condenser.

* * * * *